United States Patent [19]

Drury

[11] Patent Number: 4,744,318

[45] Date of Patent: May 17, 1988

[54] ATHLETIC SUPPORTER

[75] Inventor: Alvin C. Drury, Cincinnati, Ohio

[73] Assignee: Jung Corporation, Cincinnati, Ohio

[21] Appl. No.: 835,963

[22] Filed: Mar. 4, 1986

[51] Int. Cl.[4] ..... D05C 3/00

[52] U.S. Cl. ..... 112/262.1; 112/265.1; 112/121.26

[58] Field of Search ..... 112/262.1, 265.1, 121.26, 112/121.27, 104

[56] References Cited

U.S. PATENT DOCUMENTS

| | | | |
|---|---|---|---|
| 2,423,080 | 7/1947 | Belcher et al. | 112/130 X |
| 2,685,664 | 8/1954 | Visconti | 112/130 X |
| 3,223,059 | 12/1965 | Jacobs | 112/130 UX |
| 3,381,639 | 7/1968 | Miller | 112/130 |
| 3,515,081 | 6/1970 | Miller | 112/130 |
| 3,721,203 | 3/1973 | George | 112/121.26 |
| 3,780,682 | 12/1973 | Frost | 112/121.27 X |
| 3,871,309 | 3/1975 | Frost | 112/130 X |
| 4,112,860 | 9/1978 | Ellington et al. | 112/130 |
| 4,503,790 | 3/1985 | Keeton | 112/121.26 X |
| 4,527,493 | 7/1985 | Sallee et al. | 112/121.27 |
| 4,541,353 | 9/1985 | Engle | 112/304 |
| 4,602,579 | 7/1986 | Pollmeier | 112/121.26 |

*Primary Examiner*—Ronald Feldbaum

*Attorney, Agent, or Firm*—Wood, Herron & Evans

[57] ABSTRACT

An athletic supporter formed by a method in which a pouch and leg strap subassembly is attached to an endless length waistband by means of a continuous stitch line that is sewn along that waistband. The location of the subassembly's leg strap ends and the pouch piece, relative one to the other, on the endless waistband is established by an endless spacer chain that continuously moves along a work table over which the waist band also continuously moves, that spacer chain having a series of guide fingers against which the leg strap and pouch piece end edges are positioned by the sewing machine operator. The waistband is cut to length after the subassembly is stitched thereto by the continuous length stitch line, and the waistband's ends are then sewn together, to provide the final athletic supporter product with closed loop waistband, and with leg straps and pouch attached.

7 Claims, 2 Drawing Sheets

ATHLETIC SUPPORTER

This invention relates to athletic supporters. More particularly, this invention relates to a new athletic supporter product, a novel method for fabricating that product, and improved apparatus by which the supporter can be manufactured.

Athletic supporters are, of course, very well known to the prior art. They have been worn for many years by male athletes during competition in athletic contests and games. An athletic supporter is basically comprised of a closed loop waistband, a pouch that extends downwardly from the waist band's front section, and right and left leg straps each affixed at one end to the bottom of the pouch and at the other end at spaced locations on the waistband on opposite sides of the pouch.

The prior art methods of producing prior art athletic supporters, and the prior art equipment therefor, have been relatively labor intensive. This for the reason that an athletic supporter, even though it is comprised of only a few basic pieces, i.e., a waistband, two leg straps, and a pouch piece, requires sewing of those pieces in definite locations relative one to the other, and this requires proper orientation of those pieces by a sewing machine operator before the sewing steps can take place. In this regard, the sewing machine operator must properly locate the position of the pouch piece's upper edge relative to the waistband, and must properly locate the waist band ends of the leg straps relative to the pouch piece on the waistband, prior to sewing together those components into the completed athletic supporter product. These locations are determined manually by the sewing machine operator. In the first place this is a time consuming approach, and in the second place it is an approach which is potentially error prone in light of reliance on human labor for the critical placement step of the pouch piece and leg strap free ends in proper position relative to the waistband prior to sewing those components together. These two aspects of production tend to increase the finished cost of the final athletic supporter product.

Accordingly, it has been the objective of this invention to provide an improved athletic supporter product, a novel method for fabricating that product, and improved apparatus by which the supporter can be manufactured, in an effort to reduce the labor intensity in the manufacture of an athletic supporter which, in turn, may reduce the cost of manufacture and, therefore, the end cost of the product. In accord with this objective, this invention contemplates, in preferred form, an athletic supporter formed from a method in which a pouch and leg strap subassembly is attached to an endless length waistband by means of a continuous stitch line that is sewn along that waistband. The location of the subassembly's leg strap ends and the pouch piece, relative one to the other, on the endless waistband is established by an endless spacer chain that continuously moves along a work table over which the waistband also continuously moves, that spacer chain having a series of guide fingers against which the leg strap and pouch piece end edges are positioned by the sewing machine operator. The waistband is cut to length after the subassembly is stitched thereto by the continuous length stitch line, and the waist band's edges are then sewn together, to provide the final athletic supporter product with closed loop waistband, and with leg straps and pouch attached.

Other objectives and advantages of this invention will be more apparent from the following detailed description taken in conjunction with the drawings in which.

Figure 1:
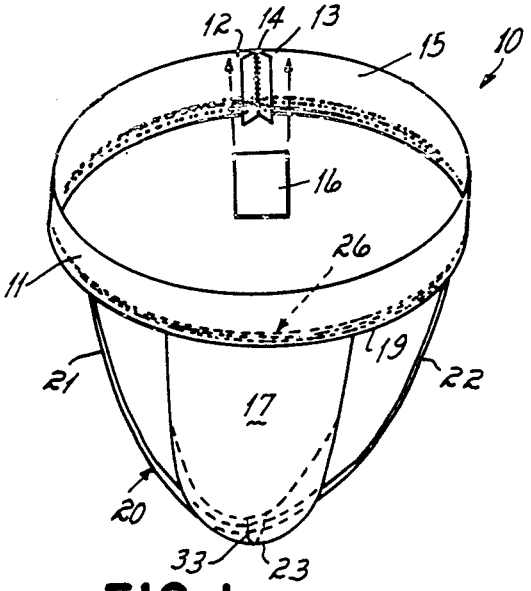
FIG. 1 illustrates an athletic supporter fabricated in accord with the principles of this invention.

An athletic supporter 10 produced in accord with the principles of this invention is illustrated in FIG. 1. The athletic supporter 10 includes a waistband 11 that has two ends 12, 13 sewn together by stitch line 14 in the middle of the rear section 15 of that waistband to establish a closed loop. A label 16, which may include the manufacturer's name and trademark, as well as the size of the athletic supporter, is stitched over that sewn joint 14. The athletic supporter 10 also includes a pouch 17 stitched along its top edge 18 to bottom edge 19 of the waistband 11, and a single length leg strap 20 that is comprised of right leg strap section 21 and left leg strap section 22. The leg strap 20 is stitched to bottom 23 of the pouch 17 as by stitch line **23*a*. Free end 24 of the right leg strap 21 is stitched to the bottom edge 19 of the waistband 11 and free end 25 of the left leg strap 22 is also stitched to the bottom edge of the waistband, those two leg strap ends 24, 25 being spaced relative one to the other and located on opposite sides of the pouch 17. The pouch's top edge 18 and the leg strap's free ends 24, 25 are stitched to the waistband's bottom edge 19 by at least one stitch line 26 (three stitcn lines 26*a*–26*c* being illustrated in the figures). Note particularly that the stitch lines 26 by which the pouch's top edge 18 and the two free ends 24, 25 of the leg straps 21, 22 are stitcned to the waistband's bottom edge 19 extend all the way around the waistband 11, i.e., the stitch lines 26 are continuous or endless in that they extend all the way around the endless loop waistband. The purpose and desirability of the continuous or endless stitch line 26 becomes more apparent upon an understanding of the manufacturing method (explained below) by which the athletic supporter 10** of this invention is fabricated.

The novel method and apparatus by which the athletic supporter 10 of this invention is manufactured is illustrated in FIGS. 2–8. Initially, a subassembly 30 comprised of pouch 17 and leg strap 20 is formed. The pouch 17 is first preformed from a single fabric piece having a top edge 18, a bottom edge and opposed side edges 31, 32, the bottom edge being overlapped and sewn together by stitch line 33 to form the pouch. A single lengtn leg strap 20, which length is approximately twice the length of the individual right leg strap section 21 and left leg strap section 22, is then sewn to the pouch 17. The leg strap 20 is sewn to the pouch 17 by stitch line **23*a* positioned approximately normal to the pouch stitch line 33, so as to subdivide approximately evenly the right leg strap section 21 and the left leg strap section 22 from the single originally cut leg strap piece 20**. This forms the subassembly.

Figure 7:
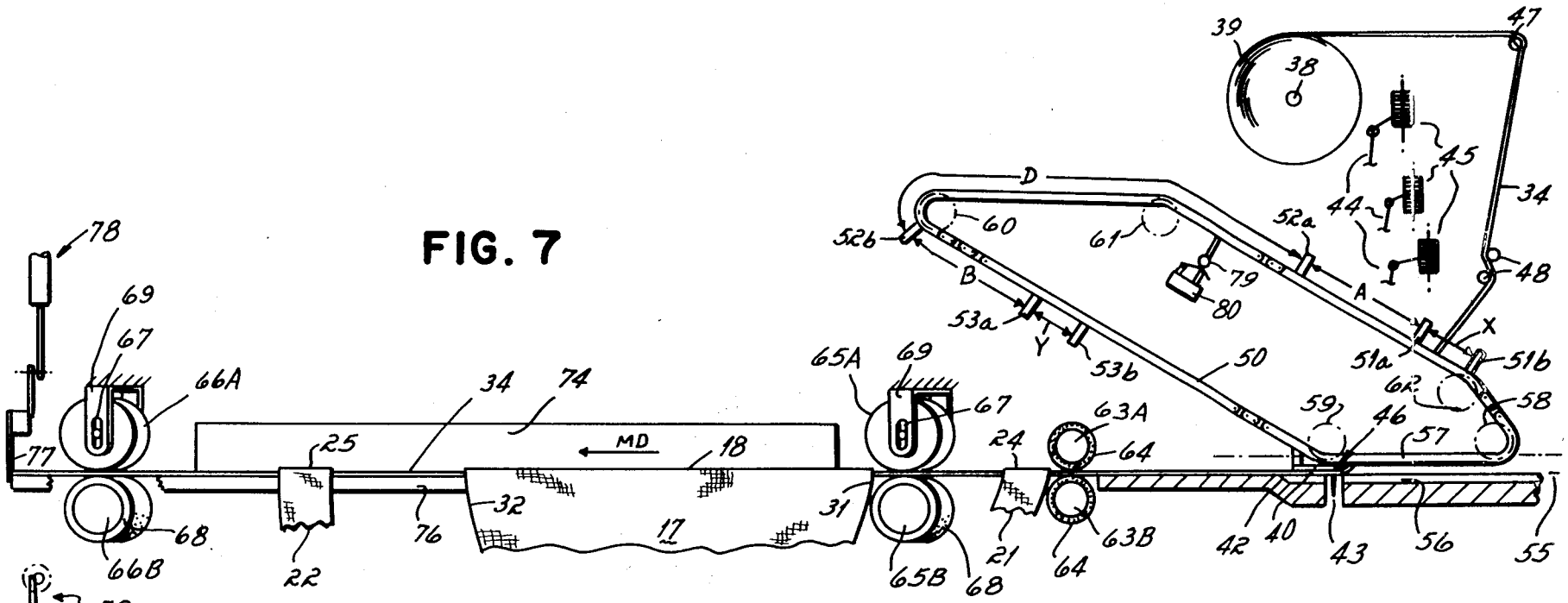
FIG. 7 is a side view illustrating apparatus by which the athletic supporter can be fabricated using the assembly method shown in FIGS. 2–6.
Figure 8:
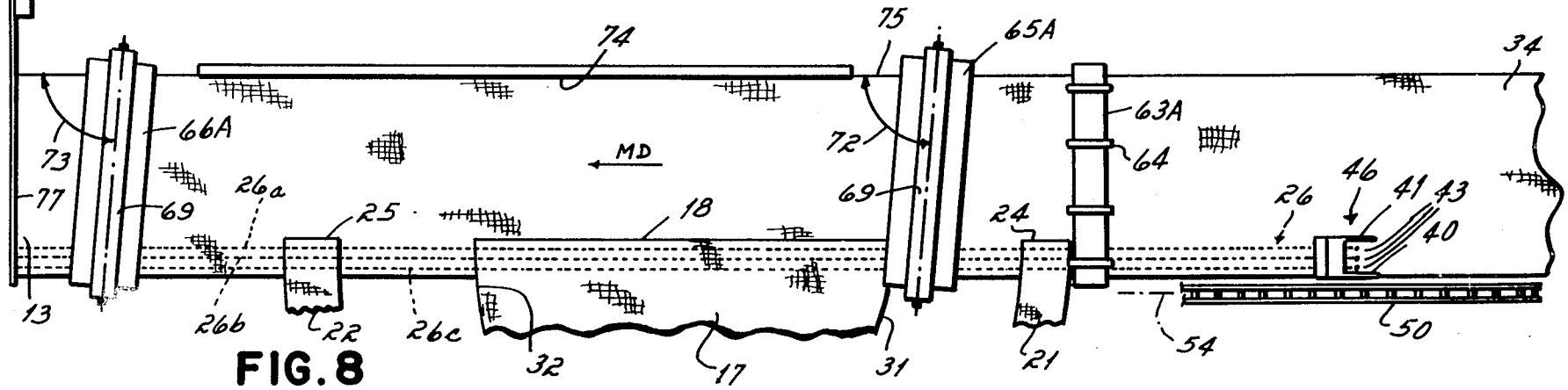
FIG. 8 is a top view of the apparatus shown in FIG. 7.

The pouch/leg strap subassembly is thereafter sewn by stitch line 26 to an endless length 34 of the waistband. The equipment for accomplishing this sewing step is illustrated in FIGS. 7 and 8. The endless length 34 of the waistband is provided on supply roll 39 held on axle 38. This equipment which is located at a stationary product fabrication area, includes a sewing machine (not shown) with presser feet 40, 41 that cooperate with work table 42. The sewing machine includes three needles 43, each fed with an endless length thread 44 on spool 45, to permit the three continuous stitch lines **26*a*–26*c* to be sewn on the endless length 34 of the waistband. Each stitch line 26 also has a bobbin (not shown) below table 42 to complete the stitches in a conventional manner. The endless length waistband is trained from supply roll 39 to stitching area 46 by spaced guides 47, 48**.

Figure 6:
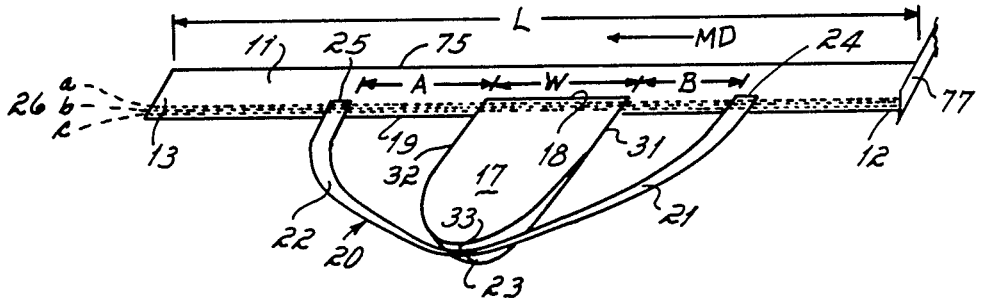
FIG. 6 illustrates a fifth step of the assembly method.

An endless spacer chain 50 having a series of guide finger pairs 51, 52, 53 is oriented in a plane 54 vertical to plane 55 of the work table 42, that chain having a run or section 57 generally parallel to, and spaced slightly above, the work table 42. This spacer chain 50 is trained around a series of sprockets 58–62, one 60 of which is a driven sprocket and the other of which are idler sprockets. The two guide fingers **52*a*, 52*b* on the spacer chain 50 are located a distance D apart exactly equal to the width W of the pouch's top edge 18 where it is to be sewn to the waistband's bottom edge 19, the guide fingers 51*a*, 51*b* are located apart a distance equal to the width of the one leg strap end 25 where the leg strap 22 is to be sewn to the waistband's bottom edge 19, and the guide fingers 53*a*, 53*b* are located a distance Y apart equal to the width of the other leg strap end 24 where the leg strap 21 is to be sewn to warstband's bottom edge. The inner guide finger 51*a* for the one leg strap 22 is spaced from the adjacent guide finger 52*a* for the pouch 17 a distance A equal to that by which the leg strap 22 is to be spaced therefrom (as shown in FIG. 6) after same has been sewn to the endless length waistband 34. Similarly, the inner guide finger 53*a* for the other leg strap 21 is spaced from the adjacent guide finger 52*b* for the pouch a distance B equal to that by which the leg strap 21 is to be spaced therefrom after same has been sewn to the endless length waistband 34. Note the guide fingers 51–53 are cooperable with a slot 56 in the work table's support surface so that same can extend beneath that work surface as the endless spacer chain 50 is driven in timed relation with drive means (described below) which pull the endless length waistband 34 off the waistband supply ro11,39**.

The endless waistband length 34 is drawn off the waistband supply roll 39 by a pair of feed rollers 63A, 63B spaced downstream (relative to machine direction MD) from the sewing machine needles 43. The feed rollers 63A, 63B are located above and below the waistband length 34 to pull same off the endless supply roll 39, and are each provided with a series of rubber tires 64. The upper feed roller 63A is moveable vertically when desired by the machine's operator, by structural means not shown, to permit the waistband length 34 to be taken out of driving engagement therewith. Further downstream in the machine direction MD are positioned two guide roller pairs 65A, 65B and 66A, 67B, each of the idler pairs having a driven roller 65B, 66B with rubber tires 68 positioned beneath the waistband. Each guide roller pair 65A, 65B and 66A, 66B also include weighted idler rollers 65A, 66A movable vertically in slot 67 of fixed frame 69 to bear on the waistband length 34 passing over the driven guide rollers 65B, 66B. This insures driving contact between the waistband length 34 and those driven guide rollers 63A, 63B, but also permits the waistband length 34 to be taken out of driving engagement with the driven rollers 65B, 66B when desired by the machine's operator. The driven guide rollers 65B, 66B are gearingly connected with the feed rollers 63A, 63B to insure constant driving interconnection there between. Note particularly, as shown in FIG. 8, the guide roller parts 65A, 65B and 66A, 66B are oriented at a slight angle 72, 73, respectively, relative to the machine direction MD of the waistband. This angular orientation creates downstream opening acute angles 72, 73 relative to guide plate 74 oriented parallel to the machine direction MD, and against which the waistband's top edge 75 bears, as it passes over support table 76. This insures that the waistband length 34 maintains its desired orientation relative to the machine direction MD as it is pulled off the supply roll 39 through the sewing area 46, i.e., insures the waistband length 34 retains its desired alignment with needles 43 so stitch lines 26 are properly oriented on the waistband's bottom edge 19 as that waistband length continuously moves past the needles 43.

A cut-off knife 77 is provided downstream of guide roller pair 66A, 66B, the knife being operated by fluid cylinder drive mechanism 78. The spacer chain 50 also mounts a trip finger 79 thereon that, when it passes an immobile switch 80, activates the drive mechanism 78 by a control circuit (not shown) so that the waistband overall length for each athletic supporter can be predetermined, and can be cut off at that length L (see FIG. 6) which is desired.

Figure 2:
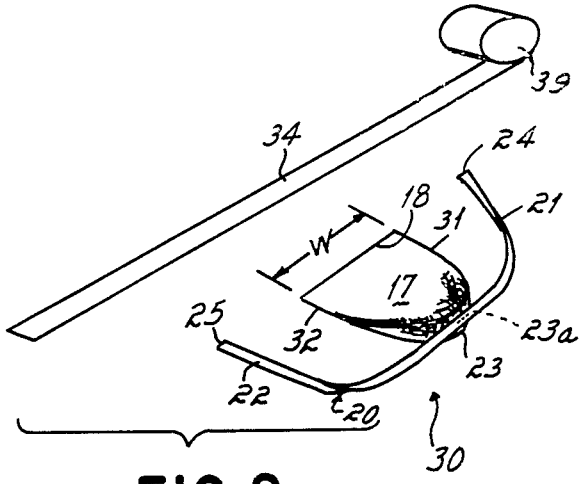
FIG. 2 illustrates a first step of the athletic supporter assembly method in accord with the principles of this invention.

In the method of this invention, a strip 34 of waistband material is trained off the endless supply roll 39 through guides 47, 48 and onto sewing or work table 42, see FIG. 7. The endless length strip 34 is also threaded through feed rollers 63A, 63B and downstream guide rollers 65A, 66A so that it is driven at a positive predetermined rate through sewing area 46, and so that it is properly aligned relative to needles 43 as it passes through that area 46. A series of supporter subassemblies 30 is provided to the sewing machine operator, each subassembly consisting of a pouch 17 and leg straps 21, 22 as previously described and as shown in FIG. 2. With the method initially set as described, the sewing needles 43 are activated so that a continuous stitch line **26*a*–26*c* is laid down along the bottom edge 19 of the waistband strip 34 as that strip is moved through the sewing area, i.e., the stitch lines 26*a*–26*c* are not intermittent but continue to be laid down on the waistband's bottom edge whether there is anything being stitched thereto or not, see FIG. 8**.

The spacer chain 50 is then started at a rate pre-determined relative to the rate at which the waistband strip 34 is moving in the machine direction MD. As the leading guide finger **51*b* on that chain for one leg strap 22 orients itself vertically relative to the work table, the machine operator places the leading side edge of one leg strap 22 adjacent to that locator finger 51*b*, thereby properly positioning and orienting same relative to the waistband strap The trailing guide finger 51*a* for the leg 34, see FIG. 3. The trailing guide finger 51*a* for the leg strap 22 subsequently entraps same therein so that it cannot be inadvertently moved by the operator, the so trapped free end 25 of that leg strap 22 thereafter passing under the sewing needles 43 at which point it is automatically sewn in the appropriately located position through use of the continuous stitch lines 26***a*–26*c* being laid down on the bottom edge of the waistband.

Figure 4:
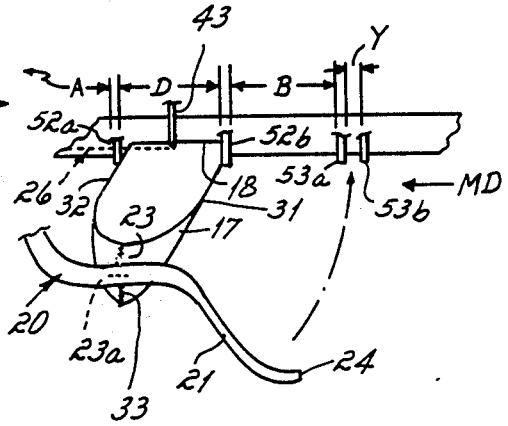
FIG. 4 illustrates a third step of the assembly method.

Subsequently, and as the spacer chain 50 moves continuously with the strip 34, the leading guide finger 52*a* for the pouch 17 is oriented vertically to the work table 42, and extends beneath the work surface thereof, so that the machine operator can locate the leading edge 32 of the pouch 17 thereagainst for properly orienting same relative to the leg strap 22, see FIG. 4. The pouch 17 is of a significant width W, and it also is sewn to the waistband's bottom edge 19 by the same stitch lines 26*a*–26*c* being continuously laid down by the sewing needles 43. The machine operator may have to stretch the width of the pouch 17 slightly so that the trailing edge 31 thereof lies against the trailing guide finger 52*b* as same comes into operational relation with the work table 42. This permits the pouch 17 to be easily sewn to the waistband's bottom edge 19 at the appropriately desired location.

Figure 5:
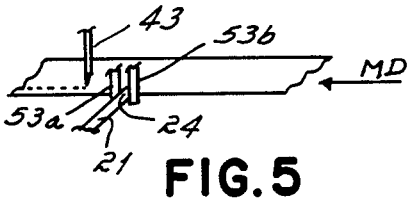
FIG. 5 illustrates a fourth step of the assembly method.

Subsequently, the leading guide finger 53*a* on the locator chain 50 comes into orientation with the work table 42, and the operator places the leading edge of that leg strap 21 against that leading guide finger, see FIG. 5. The trailing guide finger 53*b* thereafter traps the leg strap's free end 24 therebetween. The leg strap 21 thereafter passes beneath the sewing needles 43 in proper position as established by the leg strap guide fingers 53 on the locator chain, thereby also permitting that leg strap to be stitched to the waistband 11 in appropriate spaced relation relative to the pouch 17 by the same continuous stitch lines 26*a*–26*c* that stitched the leg strap 22 and pouch to that waistband.

The spacer chain 50 also includes trip finger 79 that activates switch 80 which controls cut off knife 77. The cut off knife 77 is cycled so as to cut the endless length waistband strip 34 to appropriate length L after the subassembly 30 has been sewn to that endless length strip, see FIG. 6. The so produced athletic supporter assembly as shown in FIG. 6 is thereafter dropped into a collection box (not shown). At this point only the two free ends 12, 13 of the waistband need to be sewn together to form a closed loop. The closed loop waistband is established by the stitch line 14 at the rear section of that loop, and is covered by a label 16 if desired, and as shown in FIG. 1, to provide the finished athletic supporter product.

The advantages of this athletic supporter, its fabrication method, and the apparatus for producing same, relative to the prior art, are significant and substantial. In the first place, the location of the pouch 17 and the leg straps' free ends 24, 25 relative to the continuous waistband strip 34 (and, therefor, relative to the closed waistband loop) are pre-established and pre-determined with no need for operator measurement through use of the endless spacer chain 50 and the guide fingers 51–53 connected thereto. This not only tends to reduce the possibility of operator error in connection with construction of the athletic supporter, but also tends to reduce operator time in that no measurements by the operator are required, thereby tending to reduce the cost of the athletic supporter product so manufactured.

Having described in detail the preferred embodiment of the invention, what I desire to claim and protect by Letters Patent is:

1. A method for producing an athletic supporter, said method comprising the steps of moving an endless length waistband strip through a stationary product fabrication area, attaching first the free end of a first leg strap, then the top edge of a pouch piece, and the free end of a second leg strap, to said endless waistband strip in that sequence on a section of that endless length strip, said attaching step being carried out as said endless waistband strip is moving through said product fabrication area, and said attaching step providing a supporter assembly attached to said endless length strip, providing guide fingers cooperable in timed sequence with said endless waistband strip as it passes through said fabrication area, said guide fingers being positioned relative one to the other so as to visually establish those locations on said endless waistband strip at which the free ends of said leg straps and the top edge of said pouch piece are to be attached, and thereafter cutting said endless waistband strip to that discrete length which, when the ends thereof are attached together, will establish a closed loop waistband of desired waist size, said first and second leg straps and said pouch piece thereby being attached to that discrete length prior to cutting that discrete length from said endless strip.

2. A method as set forth in claim 1, said method comprising the step of sewing a stitch line on said endless waistband strip in a direction generally parallel to the machine direction of said waistband strip through said fabrication area, said leg straps and pouch piece being attached by said stitch line.

3. A method as set forth in claim 2, said stitch line being continuously laid down along the entire length of said waistband strip.

4. A method as set forth in claim 1, said method comprising the step of providing a subassembly having said pouch and said leg straps pre-attached to one another, the free ends of said leg straps and the top edge of said pouch piece thereafter reing sewn to said endless length waistband.

5. A method for producing an athletic supporter, said method comprising the steps of moving an endless length waistband strip through a stationary product fabrication area, attaching the free end of a first leg strap, the top edge of a pouch piece, and the free end of a second leg strap, at predetermined spaced locations on a section of that endless length strip, said attaching step being carried out as said endless waistband strip is moving through said product fabrication area, and said attaching step providing a supporter assembly attached to said endless length strip, providing indicators cooperable with said endless waistband strip as it passes through said product fabrication area, said indicators serving to indicate those predetermined spaced locations on said endless length strip at which said first and second leg straps and said pouch piece are to be attached prior to attachment thereof on said endless length strip, and thereafter cutting said endless waistband strip to that discrete length which, when the ends thereof are attached together, will establish a closed loop waistband of desired waist size, said first and second leg straps and said pouch piece thereby being attached to that discrete length prior to cutting that discrete length from said endless strip.

6. A method as set forth in claim 5, said indicators being operable to visually illustrate said locations.

7. A method as set forth in claim 1, said method comprising the step of creating a trailing supporter assembly on said endless length strip as same continues to move through said product fabrication area, said trailing supporter assembly being created by the same sequence of attaching steps as was used with the leading supporter assembly, the leading cut off end of that discrete length of said waistband strip for said trailing supporter assembly being the same as the trailing cut off end of that discrete length of said waistband strip for said leading supporter assembly.

* * * * *

UNITED STATES PATENT AND TRADEMARK OFFICE

CERTIFICATE OF CORRECTION

PATENT NO. : 4,744,318

DATED : May 17, 1988

INVENTOR(S) : Alvin C. Drury

Figure 3:
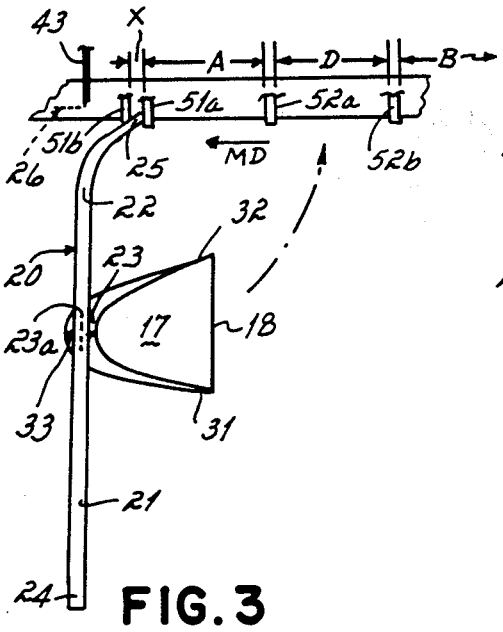
FIG. 3 illustrates a second step of the assembly method.

It is certified that error appears in the above-identified patent and that said Letters Patent is hereby corrected as shown below:

Column 4, line 65 after "strap" please insert --34, see Figure 3.--

Column 4, line 66, please delete --The trailing guide finger 51a for the leg 34, see FIG. 3--.

Column 6, line 44, delete "reing" and insert --being--

Signed and Sealed this

Twenty-ninth Day of November, 1988

*Attest:*

DONALD J. QUIGG

*Attesting Officer*

*Commissioner of Patents and Trademarks*